US005299363A

United States Patent [19]

Kraft et al.

[11] Patent Number: 5,299,363

[45] Date of Patent: Apr. 5, 1994

[54] DRYER GROUP WEB TRANSFER REGION FOR PAPER MAKING MACHINE

[75] Inventors: Wilfried Kraft; Hans-Peter Sollinger, both of Heidenheim, Fed. Rep. of Germany

[73] Assignee: J. M. Voith GmbH, Fed. Rep. of Germany

[21] Appl. No.: 825,395

[22] Filed: Jan. 24, 1992

[30] Foreign Application Priority Data

Jan. 24, 1991 [DE] Fed. Rep. of Germany ..... 9100762

[51] Int. Cl.[5] ..... F26B 11/02

[52] U.S. Cl. ..... 34/117; 34/120

[58] Field of Search ..... 34/114, 115, 116, 117, 34/120

[56] References Cited

U.S. PATENT DOCUMENTS

| | | | |
|---|---|---|---|
| 4,934,067 | 6/1990 | Wedel | 34/116 |
| 5,063,689 | 11/1991 | Sollinger | 34/117 |
| 5,065,529 | 11/1991 | Skaugen et al. | 34/117 |
| 5,101,577 | 4/1992 | Wedel | 34/117 |
| 5,105,561 | 4/1992 | Wulz | 34/117 |
| 5,144,758 | 9/1992 | Skaugen et al. | 34/117 |

FOREIGN PATENT DOCUMENTS 9001209 5/1990 Fed. Rep. of Germany .

*Primary Examiner*—Henry A. Bennet
*Assistant Examiner*—Denise L. Gromada
*Attorney, Agent, or Firm*—Ostrolenk, Faber, Gerb & Soffen

[57] ABSTRACT

A dry end of a paper making machine has a plurality of dryer groups each in turn comprised of a plurality of heatable dryer cylinders which alternate with reversal rolls. A respective support belt meanders past each dryer cylinder and the succeeding reversal roll in each dryer group. The web to be dried is supported on the side of each support belt to contact the heatable dryer cylinders. The reversal roll that precedes the first dryer cylinder in each succeeding group serves as a web removal roll which is wrapped by the second support belt of the succeeding dryer group. The first support belt of the preceding dryer group has the web on the side of the first belt which is toward the removal roll. The first support belt contacts the second support belt on the removal roll over a smaller part of the circumference of the removal roll than the second support belt. The removal roll transfers the web from the first support belt to the second support belt at the removal roll. There is an unsupported length of the first support belt from the last reversal roll of the first dryer group to the removal roll in the second dryer group that is of a length that the time of travel of a point on the first support belt between those two rolls is at least 0.05 seconds and preferably between 0.06 and 0.12 seconds. That zone is free of suction devices. The first support belt and possibly the second or preferably porous dryer wires. A boundary air layer deflection device opposite the removal roll deflects the boundary layer of air through the first support belt to help deflect the web off the first support belt onto the second support belt at the removal roll.

19 Claims, 2 Drawing Sheets

DRYER GROUP WEB TRANSFER REGION FOR PAPER MAKING MACHINE

BACKGROUND OF THE INVENTION

The present invention relates to a dry end of a paper making machine. The dry end consists of a plurality of dryer groups. Each comprises at least one and typically a plurality of dryer cylinders. The dryer cylinders in each group alternate with belt reversal rolls. A respective support belt for a web passes through each dryer group and meanders alternately to partially wrap each dryer cylinder and the following reversal roll. The invention is particularly concerned with the arrangement of reversal rolls at the transfer regions between adjacent dryer groups where the web is transferred from the support belt of a preceding dryer group to the support belt of a succeeding group. Features of such a dry end are known from Federal Republic of Germany Utility Model 90 01 209.7, which corresponds to U.S. application Ser. No. 07/467,788, filed Jan. 19, 1990. The dry end dries a fiber web, for instance, a web of paper, particularly in a paper making machine, which is designed for a very high operating speed. The highest operating speed can be about 1500 m/min, or even more. In order to achieve this, the support belts for the web are preferably porous dryer wires and the reversing rolls are preferably suction guide rolls which hold the web against the outside of the support belt as it passes around the reversing rolls.

In the above mentioned Utility Model, the web is transferred from a first dryer group comprised of a first group of dryer cylinders to a second dryer group comprised of a second group of dryer cylinders. A first suction guide roll of the second dryer group serves as a removal roll. The first support belt of the first dryer group travels around a final suction guide roll and then travels tangentially to the circumference of the removal roll, around which the second support belt of the second dryer group also travels. In front or upstream of the removal roll in the direction of travel, the first and second support belts form a so called angle of convergence, which may amount to between about 2° and 30°. This configuration is more favorable than another known arrangements also using a removal roll in which the two support belts travel a distance parallel to each other in front of the removal roll, where the web is located between the two support belts. With this parallel guidance, there is the danger that the web, which is still moist, may be subjected to injurious stressing, particularly if the two belts travel at a certain speed differential.

According to the above mentioned Utility Model, the support belt of the second dryer group comes into contact over a small portion of the circumference of the removal roll with the support belt of the first dryer group. This means that the support belt of the first dryer group wraps around the circumference of the removal roll over a small angular sector. In addition, it is proposed that this angle of wrap be variable during the operation of the machine. In this way, it is possible to transfer the web with a high degree of safety, i.e. without a substantial danger of it tearing, from the first support belt of the one dryer group to the second support belt of the next dryer group. This is true even for very high operating speeds, because impermissible stressing of the web can be avoided. If necessary, the angle of wrap may even be zero.

SUMMARY OF THE INVENTION

Although the dry end of a paper making machine described above has proven satisfactory in practice, further improvements are desirable. The present invention is based primarily on the discovery that, in order to increase the quality of the final paper web, it is necessary to permit a reduction of the longitudinal tension in the paper web at at least one place within the dry end.

At the end of a preceding, e.g. a first, dryer group, the paper web and the first support belt carrying it are provided with a relatively long and free path of travel which is free of auxiliary devices, particularly suction devices, by which the web was previously drawn as firmly as possible against the support belt. The paper web is guided in the same manner as previously by the first support belt along this free path of travel. But, the web no longer immovably adheres to the first support belt. The paper web here has the possibility of shrinking to a certain extent in the longitudinal direction which avoids longitudinal stresses. Therefore, a "quasi-free" path of the paper web is present. If necessary, this quasi-free path can even be supplemented by a small, true free path or open draw of paper. For this purpose, a small distance can be established between the two support belts at the place where the web of paper transfers from the one support belt to the other. This has the advantages that it increases the quality of the paper and primarily that it further reduces the danger of tearing of the web at the place of transfer.

In order to provide the quasi-free path of web travel, the final reversal roll of the preceding or first dryer group is spaced a distance from the removal roll so that the support belt with the web on it travels essentially without any suction devices and generally without any support over a length such that, depending upon the selected speed of the first support belt, a point on the support belt travels through that path between the reversal roll and the removal roll for at least 0.05 seconds and preferably between 0.06 and 0.12 seconds. At least the first support belt is preferably a porous dryer wire and the second support is possibly also a porous dryer wire.

Especially in a case where an air deflection device is positioned inside the first support belt, at the side of the first belt away from the web and the removal roll, the air deflection device deflects the air boundary layer on the first support belt through the porous support belt. This helps transfer the web from the first support belt to the second support belt at the removal roll.

Preferably, the unit is arranged so that the dryer cylinders for each dryer group are in a horizontal row. In one preferred embodiment, the dryer cylinders are all in horizontal rows in at least approximately one line, and that line is horizontal, so that all of the dryer cylinders are at the same height.

Other features and advantages of the present invention are described below with reference to the accompanying drawings.

DESCRIPTION OF THE PREFERRED EMBODIMENTS

Figure 1:
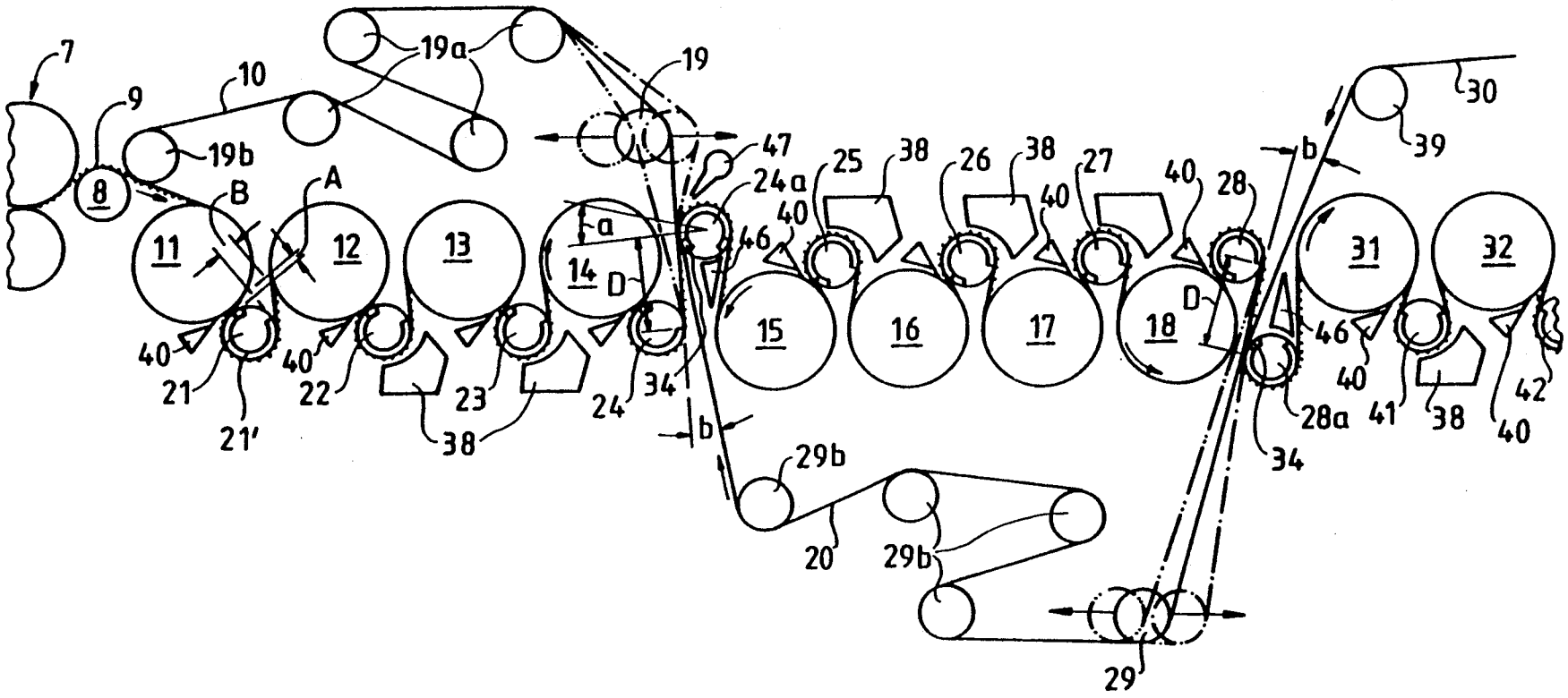
FIGS. 1 and 2 show diagrammatic side views of two different dry ends of a paper making machine.

In both figures, the paper web to be dried, which is indicated, in part, as a dotted line, travels from left to right through the dry end in what is known as a single tier dryer section. That dryer section includes a first dryer group comprised of a row of four heatable dryer cylinders 11 to 14, which are located above, and of four reversing rolls 21 to 24, which are located below, and are developed as suction guide rolls. A respective reversing roll follows each dryer cylinder to cause the web to partially wrap around each cylinder.

A paper guide roll 8 transfers the web of paper 9 from the exit end of a press section 7 to a first endless support belt 10, which is preferably developed as a dryer screen or "wire". The first support belt first travels over a guide roll **19*b* which, if deemed necessary, may be developed as a suction roll. The paper web 9 travels through the first dryer group supported on and together with the support belt 10 in a meander path, i.e. alternately over one of the dryer cylinders 11 to 14 and then over the respective adjacent one of the suction guide rolls 21 to 24. Following the last suction guide roll 24, the first support belt 10 travels over several normal belt guide rolls 19 and 19*a* back to the first belt guide roll 19*b***.

From the point of removal of the support belt 10 from each dryer cylinder 11 to 14, there is a very short radial distance A (between 30 mm and 100 mm) between the closest point on the periphery of the cylinder and the closest point on the periphery of the adjacent suction guide roll i.e. reversal roll. This prevents the web from remaining adhered to the cylindrical surface, but instead causes the web to directly follow the support belt 10. This is assured by the suction zone 21' of the suction guide roll. The suction zone extends into the non-wrapped region at the place where the support belt 10 travels onto the suction guide roll. This draws off the layer of boundary air that is transported by the support belt before that air layer might interfere with the belt 10 contacting the roll 21.

The second dryer group is comprised of four bottom dryer cylinders 15 to 18 below and five top suction guide rolls **24*a* and 25 to 28 above. A second support belt 20 travels through this dryer group. Then from the last suction guide roll 28, the support belt travels over a plurality of normal belt guide rolls 29, 29*a* and 29*b* back to the first suction guide roll 24*a* of the second group. The first suction guide roll 24*a* is a removal roll which transfers a web of paper directly from the first support belt 10 to the second support belt 20. At the end of the second dryer group, after the last suction guide roll 28 in the direction of travel, the paper web is transferred in the same manner by another removal roll 28*a* located at the start of the next or third dryer group. Only two dryer cylinders 31 and 32 of the third dryer group are visible, along with a support belt 30, suction guide rolls 41 and 42 and a belt guide roll 39**.

A first side, here the bottom side, of the paper web 9 directly contacts the dryer cylinders 11 to 14 of the first dryer group. In the second dryer group, on the other hand, the second side, here the top side, of the web 9 comes into contact with the dryer cylinders 15 to 18. The first bottom side of the web again comes into contact with the cylinders 31 and 32 in the third dryer group.

The belt guide roll 19 is arranged behind or after the last suction guide roll 24 of the first dryer group as seen in the direction of web travel. The roll 19 is displaceable back and forth in an approximately horizontal direction to select its desired position. This roll is shown in three different possible positions. In the normal central position of the roll 19, shown in solid lines, the support belt 10 travels from the roll 24 to the roll 19 on a straight path which forms a tangent to the periphery of the removal roll **24*a*. Thus, the second support belt 20 comes into contact here with the first support belt 10 at only one "point". Another possible position of the belt guide roll 19 is shown in a dash-single dot line. In this position, the second support belt 20 comes into contact with the first support belt 10 where the belt 10 is wrapped over a small part of the circumference of the removal suction roll 24*a*. This small peripheral part corresponds to an angle of wrap a of about 10°. This angle of wrap a can, however, be varied between zero and about 20° by selected displacement of the belt guide roll 19. This enables the operator of the machine to set any angle of wrap in accordance with instantaneous requirements. The operator of the machine can make the angle of wrap a dependent, for instance, on the type of paper, and/or on the operating speed and/or on the amount of the speed difference which must be at times established between the two belts 10 and 20. In this way, the transfer of the paper web 9** from the first dryer group to the second dryer group can be effected with a high degree of safety, i.e. without danger of tearing, even at very high operating speeds. Furthermore, the threading of the so called transfer strip, which is a narrow edge strip of the paper web, can be carried out automatically without need for a so called rope guide.

Regardless of how large the angle of wrap a is set, there is always a wedge shaped gap, having the angle of convergence b between the two support belts 10 and 20 in their respective paths of travel in the direction toward the removal roll **24*a***. The amount of this convergence angle b can be freely selected between about 2° and 30°, depending on the space available.

The presence of the two rolls, the suction guide roll 24 and the removal roll **24*a* where the web is transferred from the first support belt 10 to the second support belt 20 ensures that the angle of wrap around the two adjacent drying cylinders 14 and 15 essentially equals that of the wrap around most of the other drying cylinders 12, 13, 16, and 17. It also ensures that cylinders 14 and 15 will transfer more heat to the web being dried. This is in contrast to another system, not shown, wherein the web travels straight and direct from cylinder 14 to cylinder 15**.

Should the second support belt 20 retain air boundary layers on its path from the belt guide roll **29*b* to the removal roll 24*a*, which might interfere with the transfer of the web along with the support belt, it is advisable to provide a lengthened suction zone 34 in the removal roll at 24*a* or an additional pre-suction zone in that roll. This can be noted in the drawing at the place where the second support belt 20 travels onto the removal roll 24*a*. In order that the web definitely remain adhered to the support belt 20 on the path of the web from the removal roll 24*a* to the first cylinder 15 of the second dryer group, the suction zone of the removal roll 24*a* can also be lengthened on the removal side. In addition to, or as an alternative to this, a web stabilizer 46** can be provided.

There is a distance D between the last reversal roll 24 of the first dryer group and the removal roll 24a of the second dryer group which defines a free path of travel of the first support belt with the web on it. The distance D is more precisely the distance between the point where the support belt 10 travels off the reversal roll 24 to the point where the support belt 10 travels onto the removal roll 24a. This distance D should be relatively large. It is selected as a function of the speed of operation of the paper making machine. Upon its passage through this section, the paper web has an opportunity to relieve its longitudinal tension. This improves the quality of the paper and reduces the danger of the paper web tearing at the place of transfer. It has been found that a time period of the passage of a point on the support belt and the web of about 0.05 to about 0.15 seconds, and preferably 0.06 to 0.12 seconds in the space between rolls 24 and 24a over the distance D is sufficient for this. The exact time selected depends on the type of paper being produced. The distance D required for this purpose is generally between one and two meters. For the reasons indicated, it is important that the path of travel of the support belt over the distance D be free of any suction devices which would hold the web on the suction belt.

In addition, it may be advisable to shift the displaceable web guide roll 19 slightly to the left in FIG. 1 from the solid line position. This provides a small free path of paper at the place where the web 9 transfers from the first support belt 10 to the second support belt 20.

It may happen at times that one of the dryer groups must be shut down while the others continue to operate. In that event, it is advisable to temporarily establish a greater distance between the two support belts 10 and 20 at the removal roll 24a. For this purpose, the belt guide roll 19 can be shifted into a further position, which is shown in dash-double dot line in FIG. 1. The above description of the place of transfer in the region of the removal roll 24a also applies to the place of transfer in the region of the removal roll 28a where the web is transferred from the second dryer group to the third dryer group.

As is customary, a scraper 40 is provided at the free part of the surface of each dryer cylinder. Furthermore, air blow boxes 38 are provided at some of the suction guide rolls 22 to 27 and 41. To provide space for the blow boxes, each of the suction guide rolls 21–23 and 25–27 is arranged asymmetrically with respect to the two adjacent dryer cylinders. As mentioned above, a very small distance A is provided between a preceding dryer cylinder, for instance cylinder 11, and the following suction guide roll 21. On the other hand, the distance B between the suction guide roll 21 and the adjacent subsequent cylinder 12 is substantially greater, from about two to ten times greater than the distance A.

FIG. 1 furthermore shows an air scraper 47 which can direct a jet of air into the notch which is present at the place of separation of the first support belt 10 from the removal roll 24a. In general, this air scraper need not extend over the entire width of the web, but only over the region where the edge strip of the web travels upon the threading of the paper web. Use of such an air scraper 47 is advisable, among other reasons, when support belts which have reduced air permeability, for instance relatively thick plastic belts, are used. Belts of this type are preferably smooth on the outside and rough on the inside. They may be comprised of a material of low specific thermal conductivity, so that losses by heat radiation are reduced, which reduces the expenditure of energy for the heating of the dryer cylinders.

Figure 2:
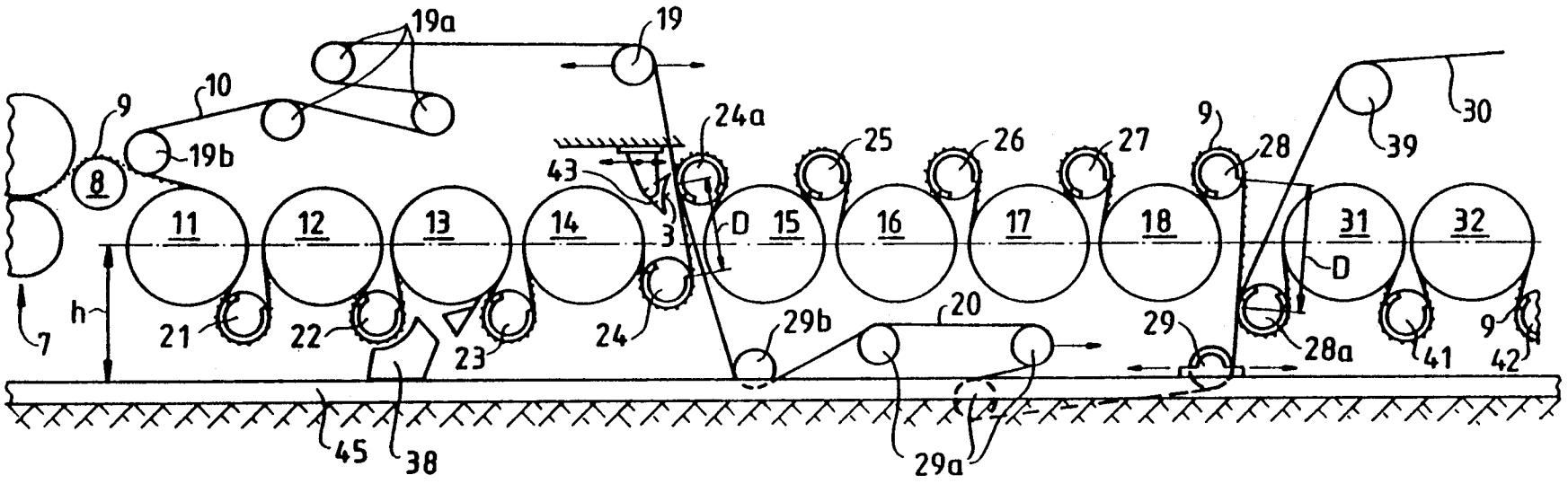

In FIG. 2, all parts of the dry end which also are found in FIG. 1 are identified with the same reference numbers as in FIG. 1. There are a first dryer group having a first support belt 10 and the cylinders 11 to 14, a second dryer group having a second support belt 20 and the cylinders 15 to 18 and the beginning of a third dryer group having a third support belt 30 and the cylinders 31 and 32. At the transfer places between adjacent dryer groups, a large distance D is provided between the last suction guide roll 24 or 28 of the preceding dryer group and the removal roll 24a or 28a of the following dryer group.

Differing from FIG. 1, all dryer cylinders 11 to 18 and 31, 32 in all dryer groups in FIG. 2 are arranged at the same height. In other words, the axes of rotation of all of the dryer cylinders lie in a single horizontal plane which lies at a distance h above the base 45. The large distance D makes this simplified cylinder arrangement more readily possible than the previously customary small distances D. The distance between the removal roll 24a and the following cylinder 15 is now less than in FIG. 1. Therefore, there is no web stabilizer here.

In addition, in FIG. 2, a deflecting device 43 for the air boundary layer is provided within the loop of the support belt 10 opposite the removal roll 24a. The curved deflection surface 3 of the device 43 conveys the oncoming layer of boundary air at the place of separation of the support belt 10 from the removal roll 24a through the pores of the support belt 10. This helps to reliably detach the web of paper from the support belt 10 to be conveyed further by the support belt 20. This deflecting device for the boundary layer of air can extend over the entire width of the machine. Alternatively, axially relatively short devices of this type can also be provided only at the edges of the web. As explained for FIG. 1, the following belt guide roll 19 is horizontally displaceable. The deflecting device 43 for the air boundary layer is accordingly also horizontally displaceable, so that it can be adapted to the corresponding path of travel of the support belt 10. Such a deflecting device 43 can also be provided opposite the removal roll 28a and at the removal rolls 24a, 28a of FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. The dry end of a machine for manufacturing a paper web, comprising:

a first dryer group comprised of a first plurality of heatable dryer cylinders, a respective first web reversal roll next to each of the first dryer cylinders, a first support belt passing alternately over a first dryer cylinder and then over the neighboring first reversal roll, the first dryer cylinders and the first reversal rolls being so placed that the first support belt partially wraps around each first dryer cylinder; the first support belt has a first side for supporting the paper web, the first support belt passes through the first dryer group together with the paper web so that the first side of the web comes into direct contact with the first dryer cylinders while the opposite second side of the web is in continuous contact with the first side of the first support belt;

a second dryer group following the first dryer group in the path of the paper web through the dry end, the second dryer group being comprised of a second plurality of heatable dryer cylinders, a respective second web reversal roll next to each of the second dryer cylinders, a second support belt passing alternately over a second dryer cylinder and then over the neighboring second reversal roll, the second dryer cylinders and the second reversal rolls being so placed that the second support belt partially wraps around each second dryer cylinder; the second support belt has a second side for supporting the paper web, the second support belt passes through the second dryer group together with the paper web so that the second side of the web comes into direct contact with the second dryer cylinders while the opposite first side of the web is in continuous contact with the support belt;

the second dryer group having a starting end following the first dryer group; a first one of the second reversal rolls precedes the first one of the second dryer cylinders of the second dryer group and serves as a removal roll for transferring the paper web from the first support belt to the second support belt; the second support belt partially wrapping the removal roll on the path of the second support belt to the first of the second dryer cylinders;

first guide means for the first support belt cooperating with the final one of the reversal rolls of the first dryer group for directing the first support belt in a path toward and past the removal roll;

second guide means for the second support belt; preceding the removal roll in the path of the second support belt to the removal roll the second guide means guiding the second support belt to the removal roll, and the second guide means and the first of the second dryer cylinders directing the second support belt to partially wrap the removal roll;

the last reversal roll of the first dryer group, the first guide means, the second guide means and the removal roll being so placed that the first support belt may contact the second support belt over a part of the periphery of the removal roll, which part is less than the part of the periphery of the removal roll wrapped by the second support belt;

the last reversal roll of the first dryer group and the removal roll of the second dryer group are spaced apart along the path of travel of the first support belt that a free travel path of the first support belt and the web traveling with the first support belt is defined, the free travel path is of such length that the travel time of a point of the support belt through the free travel path is at least 0.05 seconds; at least the first support belt is a porous dryer wire; a boundary layer of air deflection device located at the opposite side of the first support belt from the side thereof supporting the web and along the free travel path and being so placed and shaped that a boundary layer of air transported by the first support belt at the side of the first support belt toward the deflection device is deflected by the boundary layer of air deflection device through the porous dryer wire first support belt to impinge upon said web and thereby urge same to separate from said first support belt.

2. The dry end of claim 1, wherein the boundary layer of air deflection device is located along the path of the first support belt to be generally opposite the removal roll so that the deflected boundary layer of air is forced through the first support belt generally at the removal roll.

3. The dry end of claim 2, wherein the boundary layer of air deflection device includes a deflection surface facing toward the first support belt, and the deflection surface being curved generally in the same manner as the opposing region of the outer surface of the removal roll.

4. The dry end of claim 26, wherein the first support belt has a width dimension over the machine width and the boundary layer of air deflection device extends over the width of the first support belt.

5. The dry end of claim 2, wherein the first support belt has a width dimension over the width of the machine, and the boundary layer of air deflection device extends over only an axial width of a side edge region of the web.

6. The dry end of claim 1, wherein the second support belt is a porous dryer wire;

a device for drawing the web against the second support belt, the drawing device being between the place where the second support belt travels off the removal roll and a place where the second support belt travels onto the first of the second dryer cylinders.

7. The dry end of a machine for manufacturing a paper web, comprising:

a first dryer group comprised of a first plurality of heatable dryer cylinders, a respective first web reversal roll next to each of the first dryer cylinders, a first support belt passing alternately over a first dryer cylinder and then over the neighboring first reversal roll, the first dryer cylinders and the first reversal rolls being so placed that the first support belt partially wraps around each first dryer cylinder; the first support belt has a first side for supporting the paper web, the first support belt passes through the first dryer group together with the paper web so that the first side of the web comes into direct contact with the first dryer cylinders while the opposite second side of the web is in continuous contact with the first side of the first support belt;

a second dryer group following the first dryer group in the path of the paper web through the dry end, the second dryer group being comprised of a second plurality of heatable dryer cylinders, a respective second web reversal roll next to each of the second dryer cylinders, a second support belt passing alternately over a second dryer cylinder and then over the neighboring second reversal roll, the second dryer cylinders and the second reversal rolls being so placed that the second support belt partially wraps around each second dryer cylinder; the second support belt has a second side for supporting the paper web, the second support belt passes through the second dryer group together with the paper web so that the second side of the web comes into direct contact with the second dryer cylinders while the opposite first side of the web is in continuous contact with the support belt;

the second dryer group having a starting end following the first dryer group; a first one of the second reversal rolls precedes the first one of the second dryer cylinders of the second dryer group and serves as a removal roll for transferring the paper web from the first support belt to the second support belt; the second support belt partially wrapping the removal roll on the path of the second support belt to the first of the second dryer cylinders;

first guide means for the first support belt cooperating with the final one of the reversal rolls of the first dryer group for directing the first support belt in a path toward and past the removal roll;

second guide means for the second support belt; preceding the removal roll in the path of the second support belt to the removal roll the second guide means guiding the second support belt to the removal roll, and the second guide means and the first of the second dryer cylinders directing the second support belt to partially wrap the removal roll;

the last reversal roll of the first dryer group, the first guide means, the second guide means and the removal roll being so placed that the first support belt may contact the second support belt over a part of the periphery of the removal roll, which part is less than the part of the periphery of the removal roll wrapped by the second support belt;

the last reversal roll of the first dryer group and the removal roll of the second dryer group are spaced apart along the path of travel of the first support belt that a free travel path of the first support belt and the web traveling with the first support belt is defined, the free travel path is of such length that the travel time of a point of the support belt through the free travel path is at least 0.05 seconds;

at least the first support belt being a porous dryer wire;

an air boundary layer deflection device located along the free travel path at the opposite side of the first support belt from the side thereof supporting the web and being operatively positioned and shaped so that a boundary layer of air transported by the first support belt at the side of the first support belt toward the deflection device is deflected by the air boundary layer deflection device through the porous dryer wire first support belt to impinge upon said web and thereby urge same to separate from said first support belt.

8. The dry end of claim 7, wherein the length of the free travel path between the last reversal roll of the first group and the removal roll is selected so that the travel time of a point on the support belt through the free travel is between 0.06 and 0.12 seconds.

9. The dry end of claim 7, wherein the second support belt is a porous dryer wire;

a device for drawing the web against the second support belt, the drawing device being between the place where the second support belt travels off the removal roll and a place where the second support belt travels onto the first of the second dryer cylinders.

10. The dry end of claim 7, wherein each of the first and second dryer groups comprises a respective first and second plurality of the first and second dryer cylinders; the first and second dryer groups being adjacent; the first dryer cylinders of the first group and the second dryer cylinders of the second group being arranged at least approximately in a common line, one dryer cylinder after the next, and at the same height.

11. The dry end of claim 7, wherein the support belts are of a reduced porosity.

12. The dry end of claim 7, wherein the support belts are air impervious.

13. The dry end of claim 7, wherein each of the support belts has an inner side, which is the side thereof toward the reversal roll and is the side opposite the side on which the web is supported on the respective support belt, and the inner side of each support belt is a roughened inner side.

14. The dry end of claim 7, wherein the support belts are formed of a material of low specific thermal conductivity.

15. The dry end of claim 7, further comprising an air scraper supported generally at the removal roll at the place where the first support belt separates from the second support belt and directed to blow air toward the places of removal and toward the second belt and toward the web being carried on the second belt around the removal roll.

16. The dry end of claim 7, wherein the first guide means for the first support belt comprises means for supporting the first support belt to contact the second support belt at the removal roll, the first guide means being operable for also moving the first support belt away from the removal roll and from the second support belt to temporarily create separation between the first and second support belts.

17. The dry end of claim 16, wherein the first guide means for the first support belt includes the final reversal roll in the first dryer group, the final reversal roll of the first dryer group is located upstream of the removal roll in the path of the first support belt past the last reversal roll; the first guide means comprises a guide roll for the first support belt located along the path of the first support belt beyond the removal roll, the guide roll being shiftable in a direction which moves the first support belt toward and into engagement with the second support belt and with the removal roll for adjusting the degree of wrap of the first support belt around the removal roll and the guide roll being further movable to move the support belt away from the removal roll and the second support belt.

18. The dry end of claim 7, in which at least the first support belt being a porous dryer wire; in the first dryer group, the free travel path between the last reversal roll in the first dryer group and the removal roll is free of suction devices on the side of the first support belt which is away from the web being carried on the first support belt toward the removal roll.

19. A method for drying a moving web of paper having first and second surfaces on opposite sides thereof; said method including the steps of:

guiding said web along a serpentine path through a first dryer section and a second dryer section disposed downstream of said first dryer section, with said first surface contacting a first plurality of heated cylinders in said first dryer section and said second surface contacting a second plurality of heated cylinders in said second sections;

utilizing a moving closed loop first support belt having a first side in engagement with said second surface to support said web as it moves through said first second with said web being disposed between said first support belt and said first plurality of heated cylinders;

utilizing a moving closed loop second support belt having a first side in engagement with said second surface to support said web as it moves through said second section with said web being disposed between said second support belt and said second plurality of heated cylinders;

guiding said first belt through said first section along a path that is partially defined by a guide roller disposed at the downstream end of said first section with said first belt being interposed between said web and said guide roller and the latter guiding said web as it exits said first section;

guiding said second belt through said second section along a path that is partially defined by a removal roller disposed at the upstream end of said second section with said second belt being interposed between said web and said removal roller and the latter guiding said web as it enters said second section;

said serpentine path being partially defined by said guide and removal rollers with said removal roller being downstream of the guide roller, and said web being transferred from said first support belt to said second support belt in a transfer region where said guide and removal rollers are disposed;

arranging said first and second support belts to be spaced from one another in said transfer region, there being a relatively small space between said belts in a portion of said transfer region where said first belt runs past said removal roller, which space is substantially greater than the thickness of said web, whereby there is an open draw for said web as it transfers from said first belt to said second belt; and arranging an air boundary layer deflection device along the free travel path at the opposite side of the first support belt from the side thereof supporting the web, the deflection device being operatively positioned and shaped so that a boundary layer of air transported by the first support belt at the side of the first support belt toward the deflection device is deflected by the air boundary layer deflection device through the first support belt to impinge upon said web and thereby urge same to separate from said first support belt.

* * * * *